US007976240B2

(12) United States Patent
Mun

(10) Patent No.: US 7,976,240 B2
(45) Date of Patent: Jul. 12, 2011

(54) FLOOD BARRIER

(76) Inventor: Kam C. Mun, Rosemead, CA (US)

( * ) Notice: Subject to any disclaimer, the term of this patent is extended or adjusted under 35 U.S.C. 154(b) by 0 days.

(21) Appl. No.: 12/583,904

(22) Filed: Aug. 27, 2009

(65) Prior Publication Data

US 2011/0052323 A1 Mar. 3, 2011

(51) Int. Cl.
*E02B 7/08* (2006.01)

(52) U.S. Cl. ..... 405/114; 405/116; 405/107

(58) Field of Classification Search ..... 405/107, 405/114, 87, 90, 116
See application file for complete search history.

(56) References Cited

U.S. PATENT DOCUMENTS

| | | | | |
|---|---|---|---|---|
| 4,321,774 | A | 3/1982 | Fish | |
| 4,375,929 | A | 3/1983 | Clark | |
| 4,511,286 | A | 4/1985 | Hardacre | |
| 5,118,217 | A | 6/1992 | Younes | |
| 5,439,316 | A | 8/1995 | Richardson | |
| 5,645,373 | A | 7/1997 | Jenkins | |
| 6,042,301 | A * | 3/2000 | Sovran | 405/114 |
| 6,079,904 | A * | 6/2000 | Trisl | 405/107 |
| 6,132,140 | A * | 10/2000 | Kullberg | 405/114 |
| 6,334,736 | B1 | 1/2002 | Johnson et al. | |
| 6,413,014 | B1 * | 7/2002 | Melin | 405/114 |
| 6,443,655 | B1 | 9/2002 | Bennett | |
| 6,840,711 | B1 | 1/2005 | Martinez | |
| 6,843,616 | B2 | 1/2005 | Sychra | |
| 6,884,002 | B1 | 4/2005 | Fuller | |
| 7,033,112 | B2 * | 4/2006 | Rijlaarsdam | 405/107 |
| 7,121,764 | B2 * | 10/2006 | Rorheim | 405/107 |
| 7,341,402 | B1 * | 3/2008 | Schroeder | 405/107 |
| 7,364,385 | B1 | 4/2008 | Luke | |
| 7,568,863 | B2 * | 8/2009 | DeNardo | 405/114 |
| 2004/0096275 | A1 * | 5/2004 | Rorheim | 405/114 |
| 2004/0190993 | A1 * | 9/2004 | Archer-Simms et al. | 405/107 |
| 2007/0077123 | A1 * | 4/2007 | Williams et al. | 405/114 |

* cited by examiner

*Primary Examiner* — Frederick L Lagman

(57) ABSTRACT

A flood barrier comprises a plurality of panels attached together. A gasket runs continuously around the exterior periphery of each panel. When a panel is attached to an adjacent panel, the said gasket is compressed and the panels together form a watertight joint. Elongated members are attached to each panel to provide support. The bottom surface of the panel, together with the said gasket, is pressed against the ground from the weight of the floodwater and that of the panel itself. Sandbags and/or weights may be used to assist in pressing the said gasket against the ground as needed. This forms a watertight joint between the bottom surface of the panels and the ground. The attachment of a plurality of said panels together form a flood barrier. Most panels are flat panels and some are angled panels. The flat panels and angled panels can be assembled on site to surround a house or a building to form a barrier against flooding.

10 Claims, 7 Drawing Sheets

FLOOD BARRIER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to flood barriers to protect homes and buildings during a flood and in particular, panels that can be assembled on site to form a flood barrier against flooding.

2. Prior Art

Presently, sandbags and plastic sheeting are often used to form flood barriers to protect homes and buildings. This process is laborious, time consuming and cumbersome.

Other methods of flood barriers are shown in:

U.S. Pat. No. 4,321,774, U.S. Pat. No. 4,375,929, U.S. Pat. No. 4,511,286, U.S. Pat. No. 5,118,217, U.S. Pat. No. 5,439,316, U.S. Pat. No. 5,645,373, U.S. Pat. No. 6,334,736B1, U.S. Pat. No. 6,443,655 B1, U.S. Pat. No. 6,840,711 B1, U.S. Pat. No. 6,843,616B2, U.S. Pat. No. 6,884,002B1 & U.S. Pat. No. 7,364,385B1.

U.S. Pat. No. 4,321,774, U.S. Pat. No. 4,375,929, U.S. Pat. No. 4,511,286, U.S. Pat. No. 5,118,217, U.S. Pat. No. 5,645,373, U.S. Pat. No. 6,443,655 B1, U.S. Pat. No. 6,840,711B1, U.S. Pat. No. 6,843,616B2, U.S. Pat. No. 6,884,002B1 & U.S. Pat. No. 7,364,385B1 use a footing or foundation to attach the flood barrier. Alternatively, stakes, anchors, sockets or channels are made on the ground to attach the flood barrier.

U.S. Pat. No. 5,439,316 uses concrete flood barriers which are heavy, cumbersome and difficult to store.

U.S. Pat. No. 6,334,736 B1 uses a plurality of fluid filled bodies made of sheet material stacked together to form a flood barrier. It is labor intensive to form the flood barrier. These fluid filled bodies are heavy and difficult to assemble.

The present invention does not need any footing, foundation, anchor, stake or similar object to attach the flood barrier to the ground.

SUMMARY OF THE INVENTION

The present invention comprises a plurality of panels assembled on site. In the preferred embodiment, the panels are pressed against each other using removable clamps. Each panel has a gasket that runs continuously around their exterior periphery so that when they are pressed against each other, they form a watertight joint. The bottom surface of the panel, together with the said gasket, is pressed against the ground from the weight of the floodwater and that of the panel itself. Sandbags and/or removable weights may be used to assist in pressing the said gasket against the ground as needed. This forms a watertight joint between the bottom surface of the panel and the ground.

Struts are attached to the panels to provide support. In the preferred embodiment, the struts are attached to the panels by nuts and bolts. Most of the panels are flat panels and some are angled panels. The flat panels and angled panels can be assembled on site to surround a house or a building to form a flood barrier.

DETAILED DESCRIPTION OF THE PREFERRED EMBODIMENTS

Figure 1:
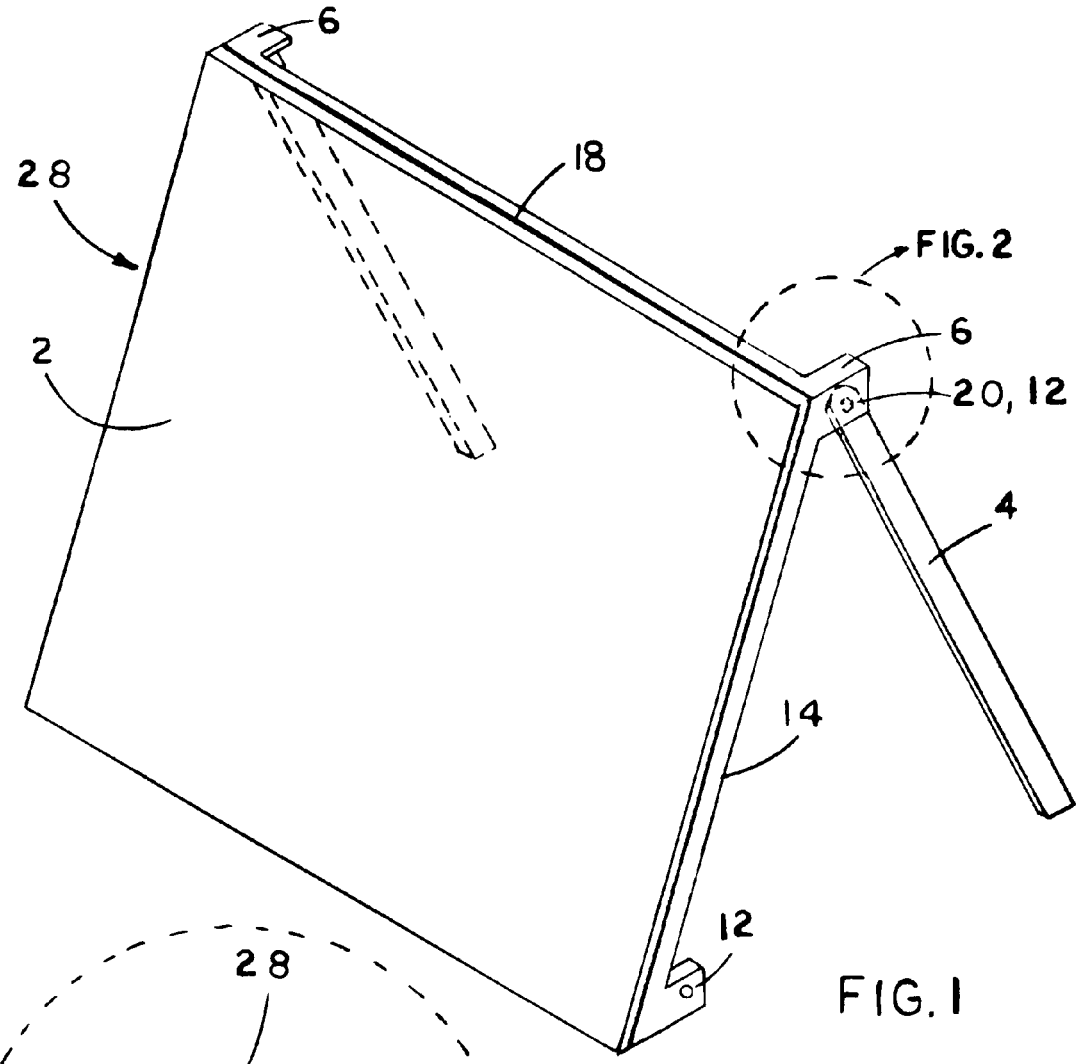
FIG. 1 a perspective view of one embodiment of the invention showing a flat panel.
Figure 9:
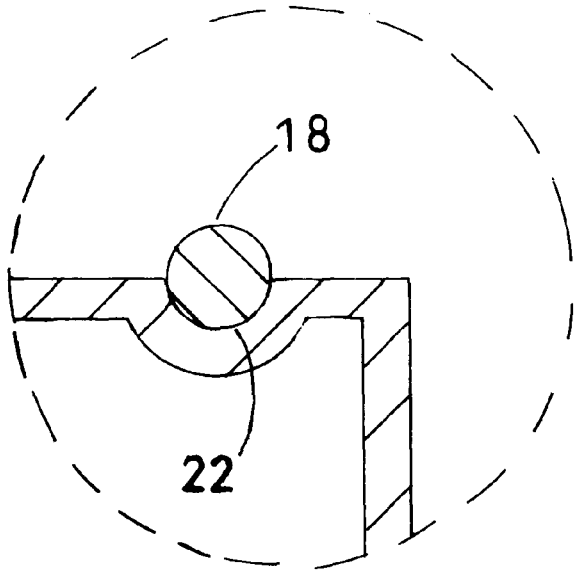
FIG. 9 is an enlarged view of one corner of one embodiment of the invention as shown in FIG. 8.

FIG. 1 shows a perspective view of one embodiment of the invention. A flat panel 28 has a front surface 2, a top surface, a bottom surface and a pair of side surfaces 14. It is supported by struts 4. A gasket 18 sits in a groove 22 that runs continuously around the exterior periphery of the flat panel 28. The groove 22 is shown in FIG. 9. In the preferred embodiment, the flat panel 28 is made of molded plastic such as polystyrene. Other materials may be used. For example, it may be made of foam or sheet metal such as aluminum or steel.

Figure 2:
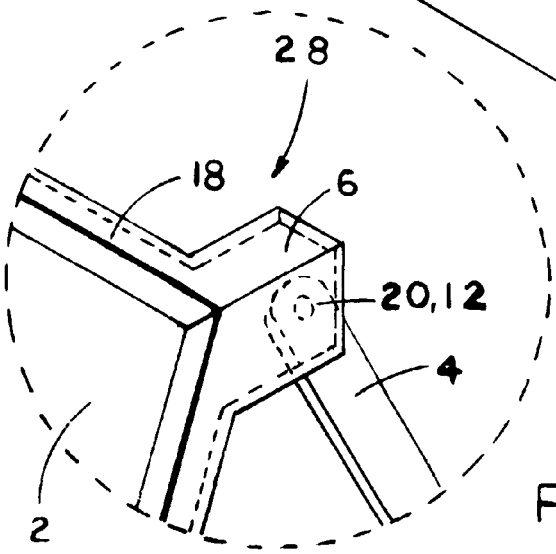
FIG. 2 is an enlarged view of one corner of one embodiment of the invention as shown in FIG. 1.

Referring to FIG. 2, the flat panel 28 has four legs 6, each with a hole 12. The strut 4 has a hole 20. It is attached to the leg 6 of the flat panel 28 by aligning the holes, 12 and 20, and tightened using a nut and a bolt. Other means of attachment may be used. For example, one may use screws to attach strut 4 to leg 6 or they may be clamped together using G clamps or they may be tied together using ropes.

Figure 3:
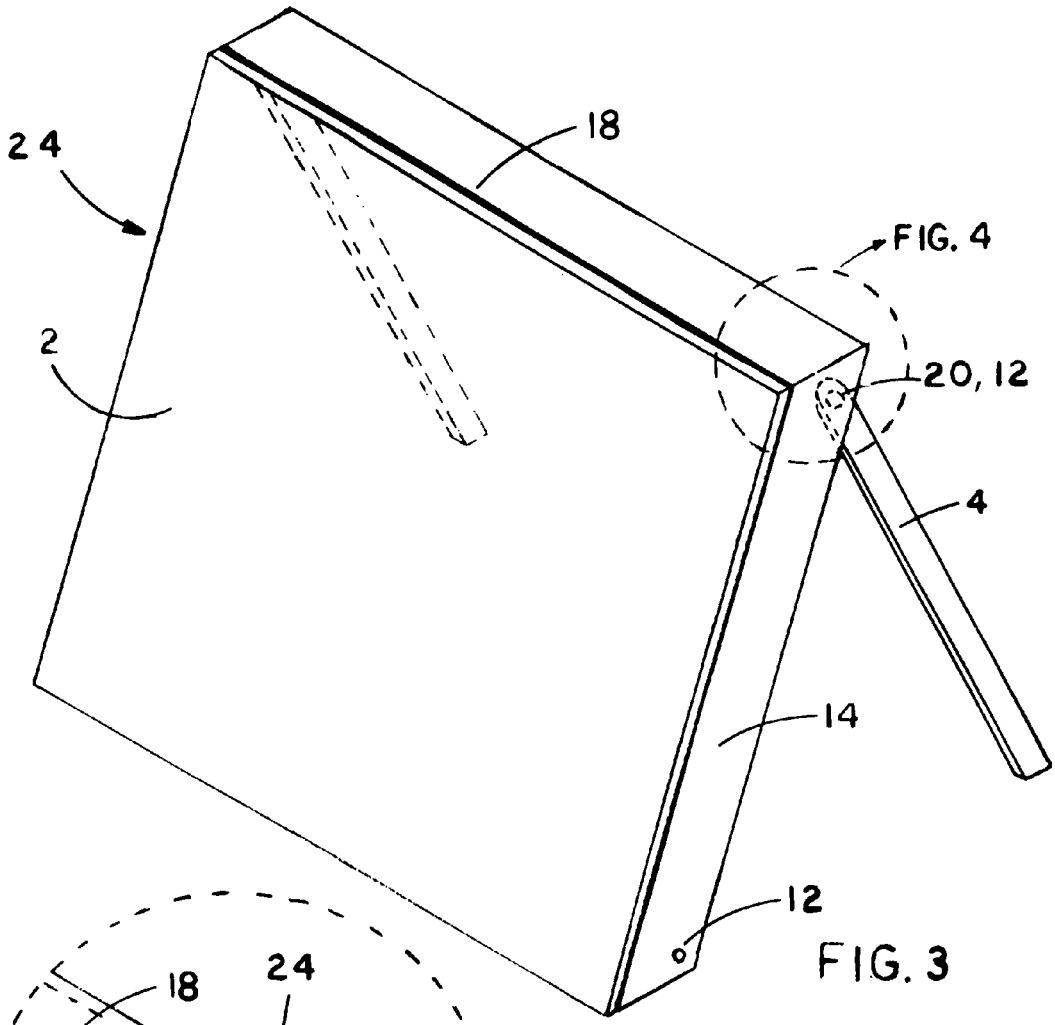
FIG. 3 is a perspective view of one embodiment of the invention showing a flat panel.

FIG. 3 shows another embodiment of the invention where the top and bottom surfaces and the pair of side surfaces 14 have been elongated so that there is no need for legs 6. A flat panel 24 has a front surface 2, a top surface, a bottom surface and a pair of side surfaces 14. It is supported by struts 4. A gasket 18 sits in a groove 22 that runs continuously around the exterior periphery of the flat panel 24. The groove 22 is shown in FIG. 9.

Figure 4:
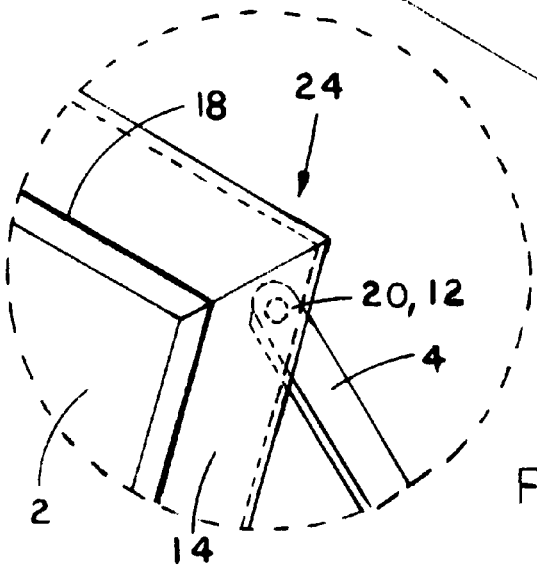
FIG. 4 is an enlarged view of one corner of one embodiment of the invention as shown in FIG. 3.

Referring to FIG. 4, the flat panel 24 has four holes 12 made on the pair of side surfaces 14 as shown. The strut 4 has a hole 20. The strut 4 is attached to the side surface 14 of the flat panel 24 by aligning the holes, 12 and 20, and tightened using a nut and a bolt. Other means of attachment may be used.

Figure 5:
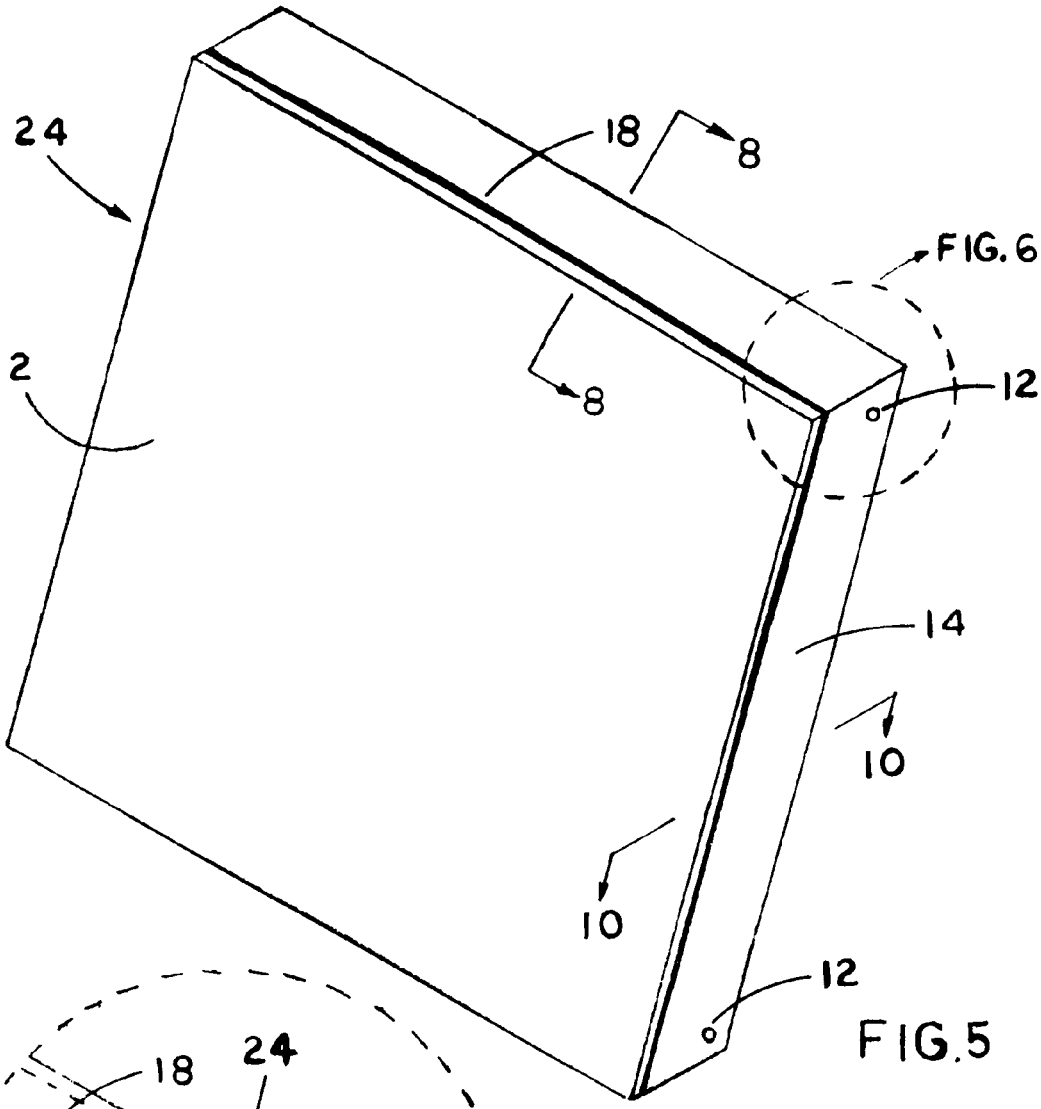
FIG. 5 is a perspective view of one embodiment of the invention as shown in FIG. 3 with the struts removed for clarity.
Figure 6:
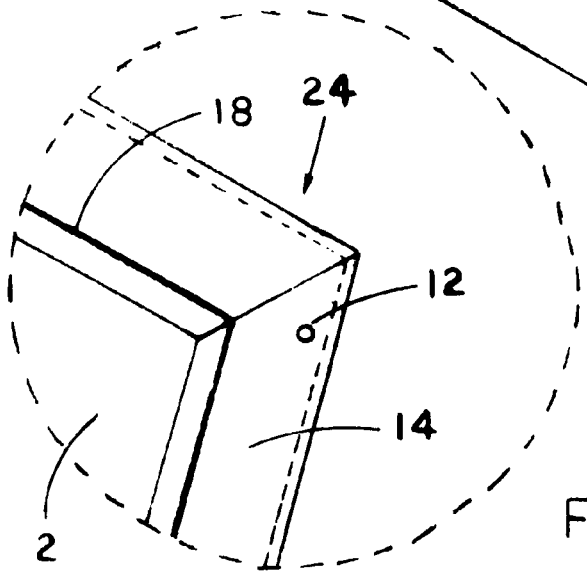
FIG. 6 is an enlarged view of one corner of one embodiment of the invention as shown in FIG. 5.

FIG. 5 shows a flat panel 24 with a front surface 2, a top surface, a bottom surface and a pair of side surfaces 14. The struts 4 are not shown for clarity.

Figure 7:
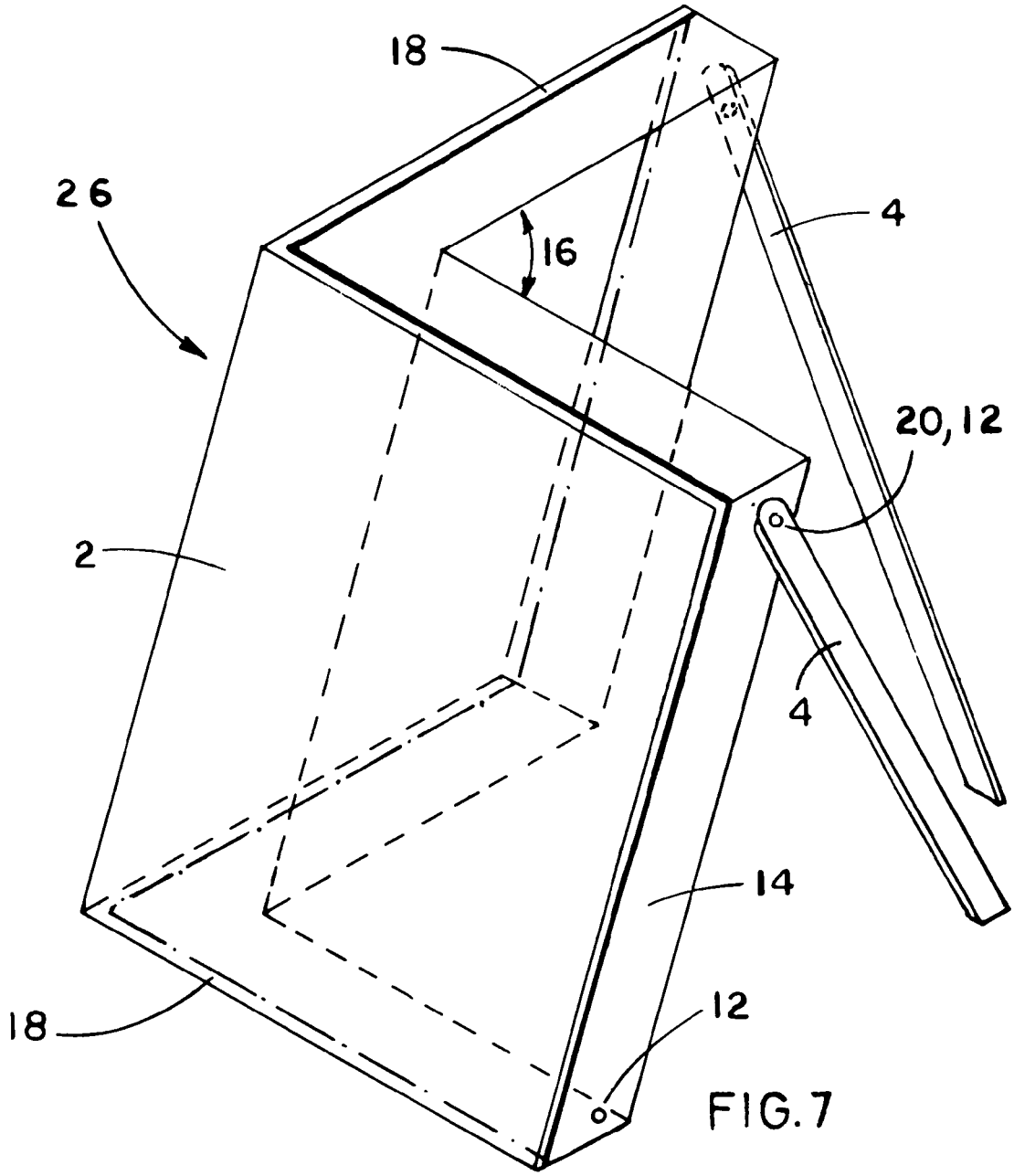
FIG. 7 is a perspective view of one embodiment of the invention showing an angled panel.

FIG. 7 shows an angled panel 26 with a front surface 2, a top surface, a bottom surface and a pair of side surfaces 14. It is supported by struts 4. The strut 4 is attached to the side surface 14 of the angled panel 26 by aligning the holes, 12 and 20, and tightened using a nut and a bolt. Other means of attachment may be used. The preferred embodiment of the angled panel 26 has an angle 16 of 90 degrees or 145 degrees but is not limited to such degrees. Other magnitudes of angles may be used.

Figure 8:
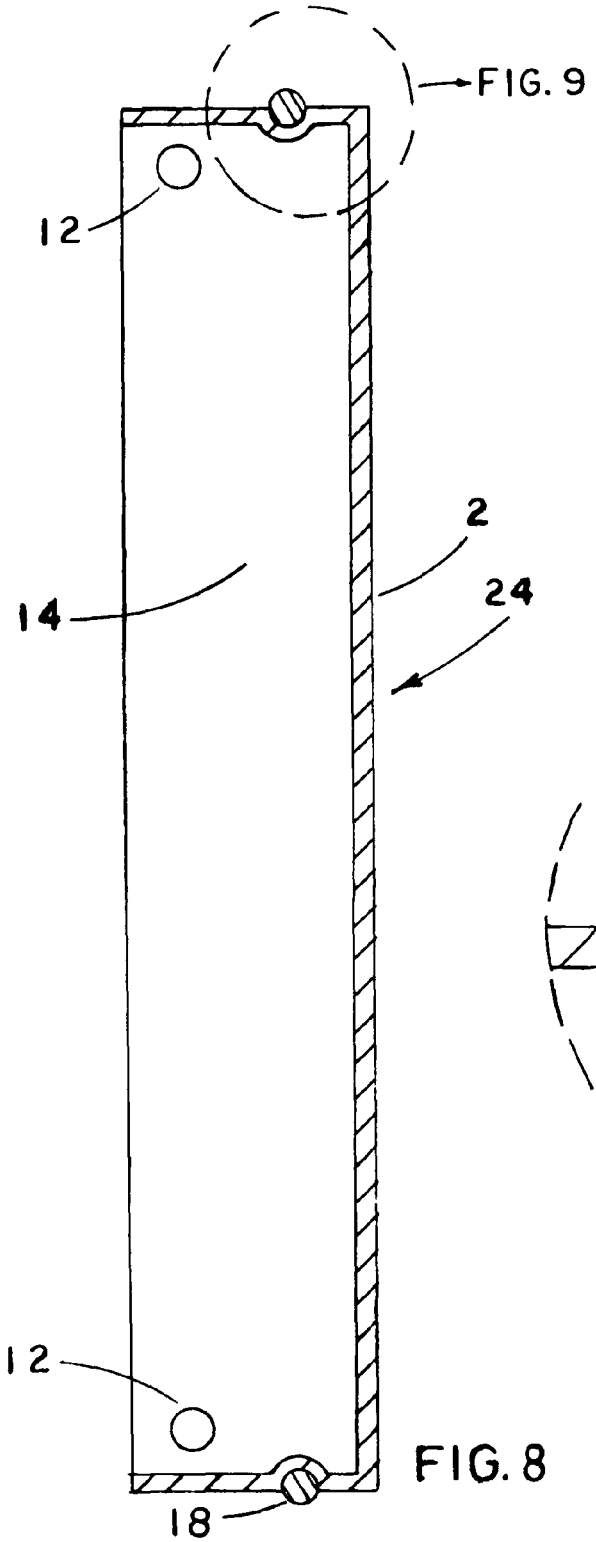
FIG. 8 is a cross sectional view of one embodiment of the invention taken from the cut 8-8 as shown in FIG. 5.

Referring to FIG. 8, a gasket 18 sits in a grove 22 that runs continuously around the exterior periphery of the flat panel 24. In FIG. 9, the gasket 18 protrudes from the pair of side surfaces 14.

Figure 10:
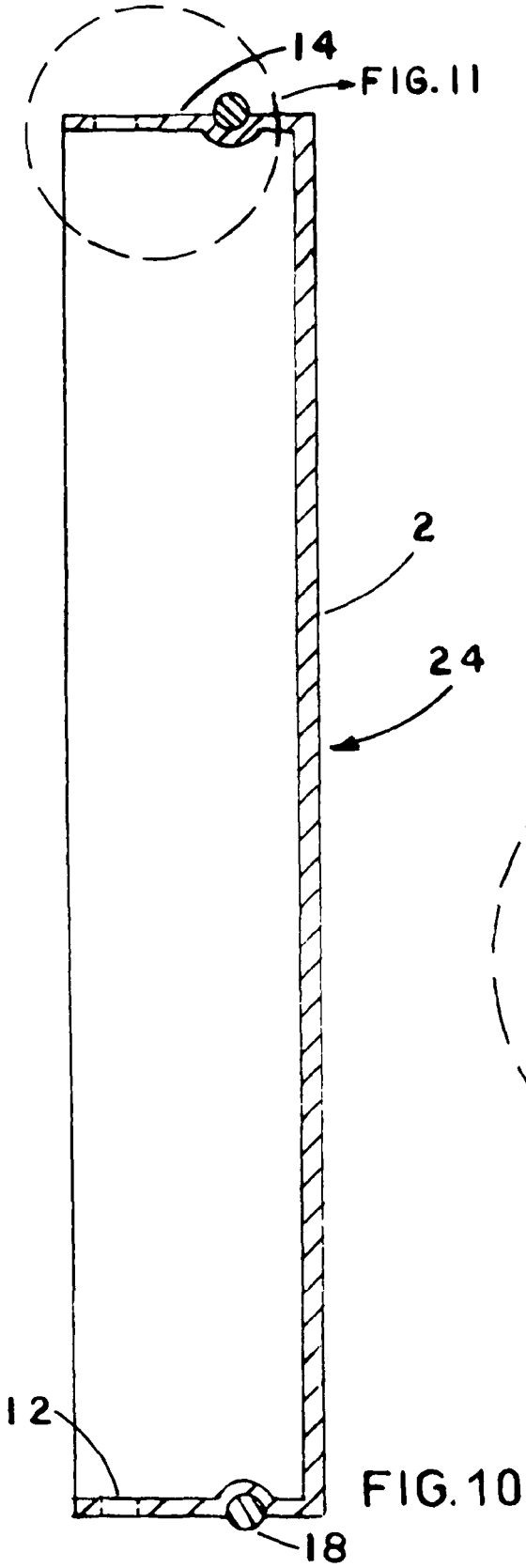
FIG. 10 is a cross sectional view of one embodiment of the invention taken from the cut 10-10 as shown in FIG. 5.
Figure 11:
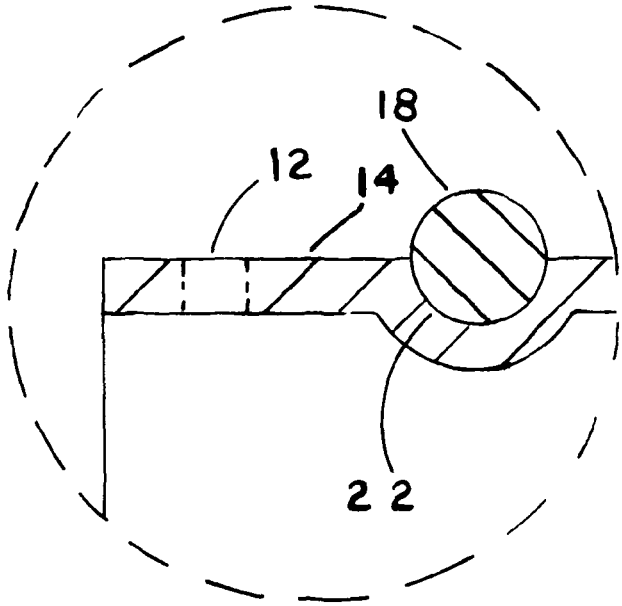
FIG. 11 is an enlarged view of one corner of one embodiment of the invention as shown in FIG. 10.

Referring to FIG. 10, a gasket 18 sits in a groove 22 that runs continuously around the exterior periphery of the flat panel 24. In FIG. 11, the gasket 18 protrudes from the pair of side surfaces 14.

Figure 12:
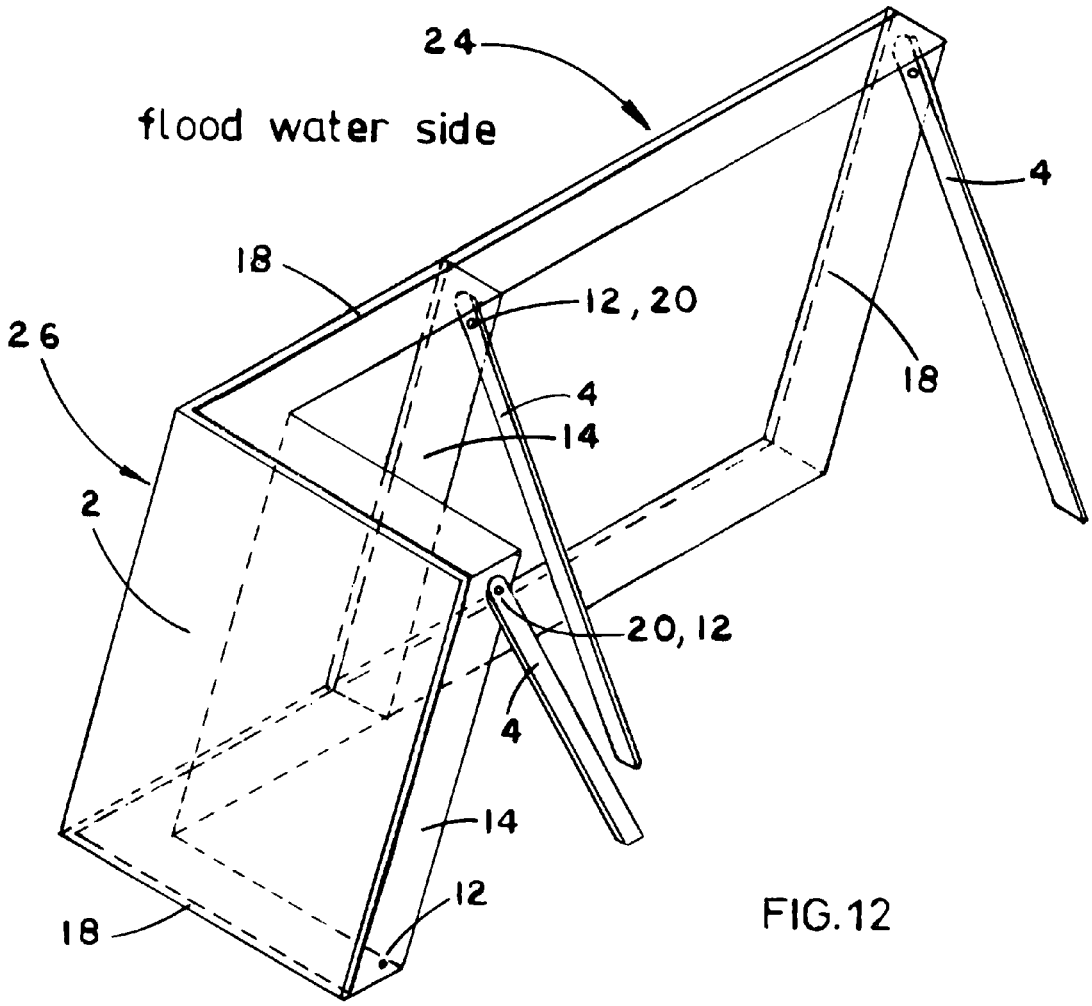
FIG. 12 is a perspective view of one embodiment of the invention showing an angled panel attached to a flat panel and supported by struts.

FIG. 12 shows an angled panel 26 attached to a flat panel 24. The side surface 14 of the angled panel 26 is pressed against the side surface 14 of the flat panel 24 using removable clamps such as G clamps. These clamps are not shown for clarity. This causes the gasket 18 of angled panel 26 to be pressed against gasket 18 of flat panel 24 along the side surfaces 14. This forms a watertight joint between the adjacent panels 24 and 26.

Similarly, all the panels are pressed against adjacent panels along the side surfaces 14 using removable clamps such as G clamps. Other means of attachment may be used. For example, one may use screws or nuts and bolts to attach the panels together.

The bottom surface of the panels, and hence the gasket 18 which runs continuously around the exterior periphery of the panels, are made to press against the ground by the use of sandbags and/or weights as needed. This forms a watertight joint between the panels and the ground.

In the preferred embodiment, the front surface 2 of the panels are angled away from the flood water at an inclined orientation to the flood water so that the weight of the flood water and the weight of the panels are used to press down on the panels against the ground. In another embodiment of this invention, the panels may be in a substantially vertical orientation to the flood water. The panels are assembled on site to surround a home or a building to form a flood barrier.

Referring to FIG. 12, both panels 24 and 26 are supported by struts 4. A strut 4 is attached to the side surfaces 14 of the two adjoining panels 24 and 26 by aligning the two holes 12 of the two adjoining panels 24 and 26 with the hole 20 of the strut 4. A bolt is then made to pass through the two holes 12 of the two adjoining panels 24 and 26 and the hole 20 of the strut 4 and subsequently tightened with a nut. By tightening the nut and the bolt, the two adjacent panels of 24 and 26 are pressed against each other at the side surfaces 14. This presses the gasket 18 of flat panel 24 against the gasket 18 of angled panel 26 to form a watertight joint.

In the preferred embodiment, all the panels are attached to all the struts using nuts and bolts. Other means of attachment may be used. For example, one may use screws to attach strut 4 to the panels 24 and 26 as shown in FIG. 12 or they may be clamped together using G clamps or they may be tied together using ropes.

If there are areas of uneven ground, the low spots should be filled with a combination of sandbags, plastic sheeting and sand to level the ground before the panels are assembled on site. To minimize water leakage due to the uneven ground, one embodiment of the invention is such that the panel is substantially shorter along its width when compared to its height. For example, such a panel can be 2 feet wide by 4 feet high. In another embodiment of the invention, a plurality of rows of gasket 18 sit in grooves 22 that run continuously and substantially parallel to each other, around the exterior periphery of the panels.

I claim:

1. A flood barrier comprising:

a. a panel having a top surface, a bottom surface, a pair of side surfaces and an exterior periphery;

b. a gasket that sits in a groove running continuously around the exterior periphery of said panel;

c. a plurality of elongated support members;

d. said support members being attached to said panel at spaced locations to support said panel in a substantially vertical orientation or at an inclined orientation;

e. means to attach a plurality of said panels together to form a flood barrier.

2. The flood barrier of claim 1 wherein a plurality of holes on said pair of side surfaces of said panel.

3. The flood barrier of claim 1 wherein said panel is a flat panel.

4. The flood barrier of claim 1 wherein said panel is an angled panel.

5. The flood barrier of claim 1 wherein said panel has a bottom surface that is shorter than each of its pair of side surfaces.

6. A flood barrier comprising:

a. a sheet of rigid material having a top surface, a bottom surface, a pair of side surfaces and an exterior periphery;

b. a gasket that sits in a groove running continuously around the exterior periphery of said sheet of rigid material;

c. a plurality of elongated support members;

d. said support members being attached to said sheet of rigid material at spaced locations to support said sheet of rigid material in a substantially vertical orientation or at an inclined orientation;

e. means to attach a plurality of said sheets of rigid material together to form a flood barrier.

7. The flood barrier of claim 6 wherein a plurality of holes on said pair of side surfaces of said sheet of rigid material.

8. The flood barrier of claim 6 wherein said sheet of rigid material is flat.

9. The flood barrier of claim 6 wherein said sheet of rigid material is angled.

10. The flood barrier of claim 6 wherein said sheet of rigid material has a bottom surface that is shorter than each of its pair of side surfaces.

* * * * *